US006484411B1

(12) United States Patent
Nixon

(10) Patent No.: US 6,484,411 B1
(45) Date of Patent: Nov. 26, 2002

(54) SIDING LAYOUT TOOL

(76) Inventor: Russell Nixon, 31 Glenwood Crescent, Stony Plain, Alberta (CA), T7Z 1A3

( * ) Notice: Subject to any disclaimer, the term of this patent is extended or adjusted under 35 U.S.C. 154(b) by 0 days.

(21) Appl. No.: 09/713,925

(22) Filed: Nov. 15, 2000

(30) Foreign Application Priority Data

Nov. 15, 1999 (CA) ..... 2289800

(51) Int. Cl.[7] ..... B43L 13/00
(52) U.S. Cl. ..... 33/33; 33/42; 33/411
(58) Field of Search ..... 33/32.1, 32.2, 33/32.5, 32.7, 33, 42, 526, 648, 646, 647, 481, 411, 649, 41.1, 41.4, 41.5, 41.6, 44, 666, 677

(56) References Cited

U.S. PATENT DOCUMENTS

| | | | | | |
|---|---|---|---|---|---|
| 72,885 | A | * | 12/1867 | Nester | 33/33 |
| 349,523 | A | * | 9/1886 | Schmidt | 33/33 |
| 810,246 | A | * | 1/1906 | Anderson | 33/42 |
| 913,871 | A | * | 3/1909 | Baightel | 33/33 |
| 1,255,190 | A | * | 2/1918 | McBride | 33/41.1 |
| 1,780,849 | A | * | 11/1930 | Spillman | 33/33 |
| 3,986,418 | A | | 10/1976 | Lang et al. | 83/41 |
| 4,407,179 | A | | 10/1983 | Iwase et al. | 83/865 |
| 4,510,834 | A | | 4/1985 | Greene et al. | 83/453 |
| 4,879,818 | A | | 11/1989 | Beaulieu | 33/646 |
| 4,955,305 | A | | 9/1990 | Garnier et al. | 112/121.11 |
| 4,956,919 | A | * | 9/1990 | Granger | 33/32.2 |
| 4,970,600 | A | | 11/1990 | Garnier et al. | 358/299 |
| 5,010,795 | A | | 4/1991 | Kania | 83/607 |
| 5,038,477 | A | | 8/1991 | Parrow | 30/253 |
| 5,038,483 | A | * | 8/1991 | Witek | 33/42 |
| 5,195,412 | A | | 3/1993 | Flemming et al. | 83/37 |
| 5,203,090 | A | | 4/1993 | Bouska et al. | 33/481 |
| 5,251,524 | A | | 10/1993 | Clifford | 83/383 |
| 5,375,339 | A | | 12/1994 | Noel, Jr. | 33/518 |
| 5,456,015 | A | * | 10/1995 | Butcher et al. | 33/451 |
| 5,625,992 | A | | 5/1997 | Strick et al. | 52/656.9 |
| 5,822,871 | A | * | 10/1998 | Walker | 33/27.03 |

* cited by examiner

*Primary Examiner*—Diego Gutierrez
*Assistant Examiner*—Mirellys Jagan
(74) *Attorney, Agent, or Firm*—Christensen O'Connor Johnson Kindness PLLC

(57) ABSTRACT

A siding layout tool includes a body having a first face, a second face and at least one alignment guide. A plurality of holes extend through the body from the first face to the second face. A member is provided having a working end. The member is received in a selected one of the plurality of holes in the body, with the working end extending from the second face. The siding layout tool, as described, permits one handed operation, which leaves the users other hand free.

2 Claims, 6 Drawing Sheets

SIDING LAYOUT TOOL

FIELD OF THE INVENTION

The present invention relates to a siding layout tool

BACKGROUND OF THE INVENTION

U.S. Pat. No. 5,203,090 which issued to Bouska et al in 1993 describes a siding layout tool. The siding layout tool of Bouska et al consists of a plate with an upper panel, a lower panel and a step positioned inbetween. The upper panel and the lower panel each have a number of openings. A pencil or a blade of a utility knife is inserted into a selected one of the openings. The step is positioned against a ridge on a piece of siding. The ridge of the piece of siding is then used as a guide in making a longitudinal mark on the siding with either the pencil or the blade of the utility knife.

When using the Bouska et al siding layout tool, two hands are required. One hand holds the siding layout tool and the other hand holds the pencil or the utility knife. This two handed operation has proven to be a limiting factor for the Bouska et al tool. It would be preferable if it was capable of one handed operation, in order to free up one of the users hands to prevent movement of the siding.

SUMMARY OF THE INVENTION

What is required is a siding layout tool capable of one handed operation.

According to the present invention there is provided a siding layout tool which includes a body having a first face, a second face and at least one alignment guide. A plurality of holes extend through the body from the first face to the second face. A member is provided having a working end. The member is received in a selected one of the plurality of holes in the body, with the working end extending from one of the first face and the second face.

With the siding layout tool, as described above, the member that scores or marks the siding forms part of the tool. This permits one handed operation. There is no need to hold a pencil, utility knife, or scoring instrument in position with one's other hand.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
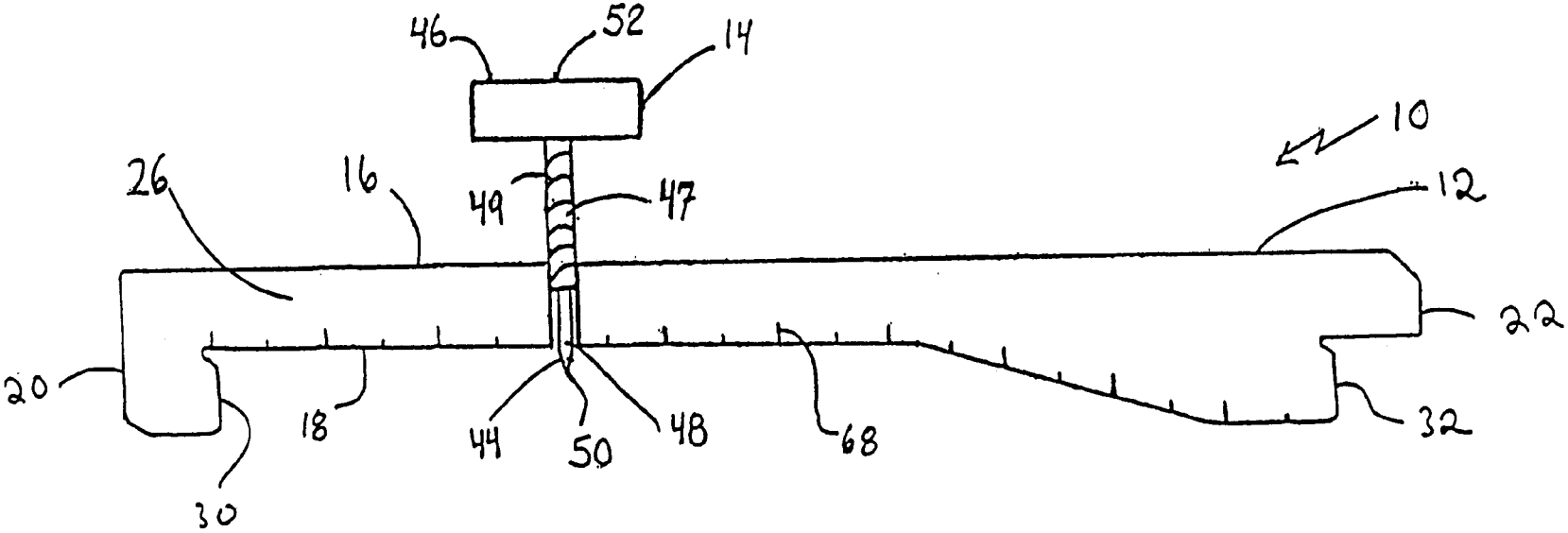
FIG. 1 is a side elevation view of a siding layout tool constructed in accordance with the teachings of the present invention.

The preferred embodiment, a first embodiment of a siding layout tool generally identified by reference numeral 10, will now be described with reference to FIGS. 1 through 5. An alternative embodiment of a siding layout tool generally identified by reference numeral 100, will then be described with reference to FIG. 6.

Figure 2:
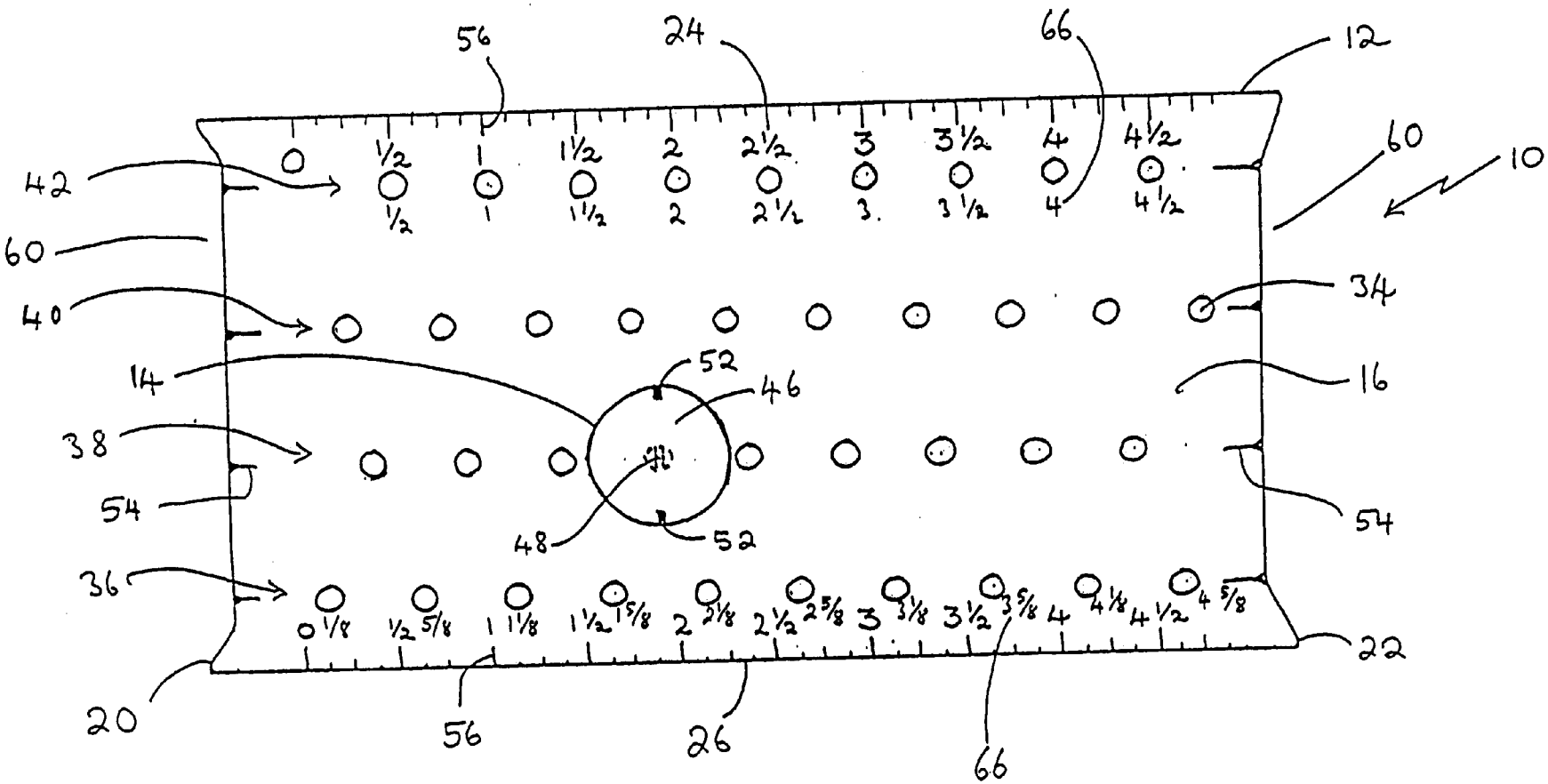
FIG. 2 is a top plan view of the siding layout tool illustrated in FIG. 1.
Figure 4:
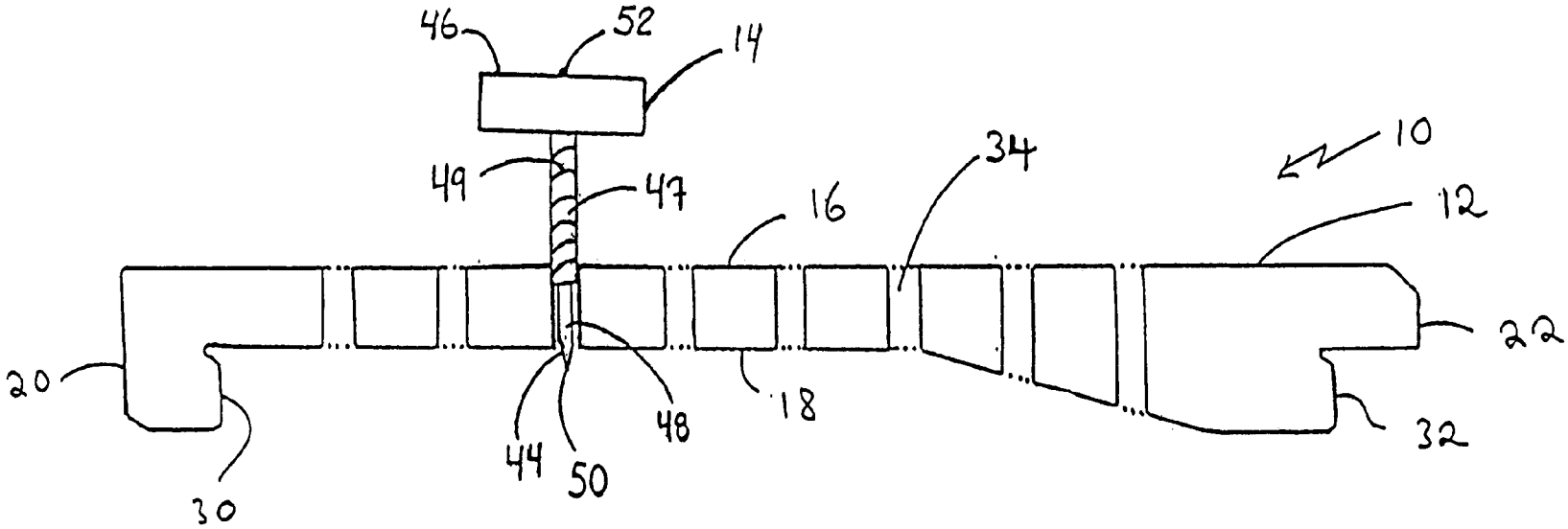
FIG. 4 is a side elevation view, in section, the siding layout tool illustrated in FIG. 1.

Referring to FIG. 1, preferred embodiment of siding layout tool 10 includes a body 12 and a member 14. Body 12 has a first face 16, a second face 18, a first end 20, and a second end 22. Referring to FIG. 2, body 12 has a first side 24, and a second side 26. Referring to FIG. 1, a first alignment guide 30 projects outwardly from second face 18 at first end 20. A second alignment guide 32 projects outwardly from second face 18 at second end 22. Referring to FIGS. 2 and 4, a plurality of holes 34 extend through body 12 from first face 16 to second face 18. Holes 34 either have internal threads or are able to receive a threaded member, as will hereinafter be further described. Referring to FIG. 2, holes 34 are aligned in rows that extend between first end 20 and second end 22. For purposes of illustration, holes 34 are shown in four rows corresponding to intervals of one-half of one inch on the Imperial scale, a first row 36 starting at a one-eighth inch position, a second row 38 starting at a three-eighths inch position, a third row 40 starting at a one-quarter inch position, and a fourth row 42 starting at a one-half inch position from first alignment guide 30. The number of rows of holes 34 and the spacing of the rows and holes 34 within each row is selected to provide a variety of positions relative to one or both of first alignment guide 30 and second alignment guide 32. The rows do not have to be exactly as illustrated, but can vary and still provide a variety of positions. First numeric indicia 54 define the relationship each of the rows has to one of first side 24 and second side 26. Second numeric indicia 56 define the relationship each of the plurality of holes 34 has to one of first alignment guide 30 at first end 20 and second alignment guide 32 at second end 22. For purposes of illustration only, second numeric indicia 56 are shown as Imperial scale units in FIG. 2. It is preferred that an indentation 60 extends the majority of the width of each of first end 20 and second end 22, so that a position of first numeric indicia 54 on a section of siding 28, shown in FIG. 5, can be viewed as body 12 is moved along section of siding 28.

Figure 3:
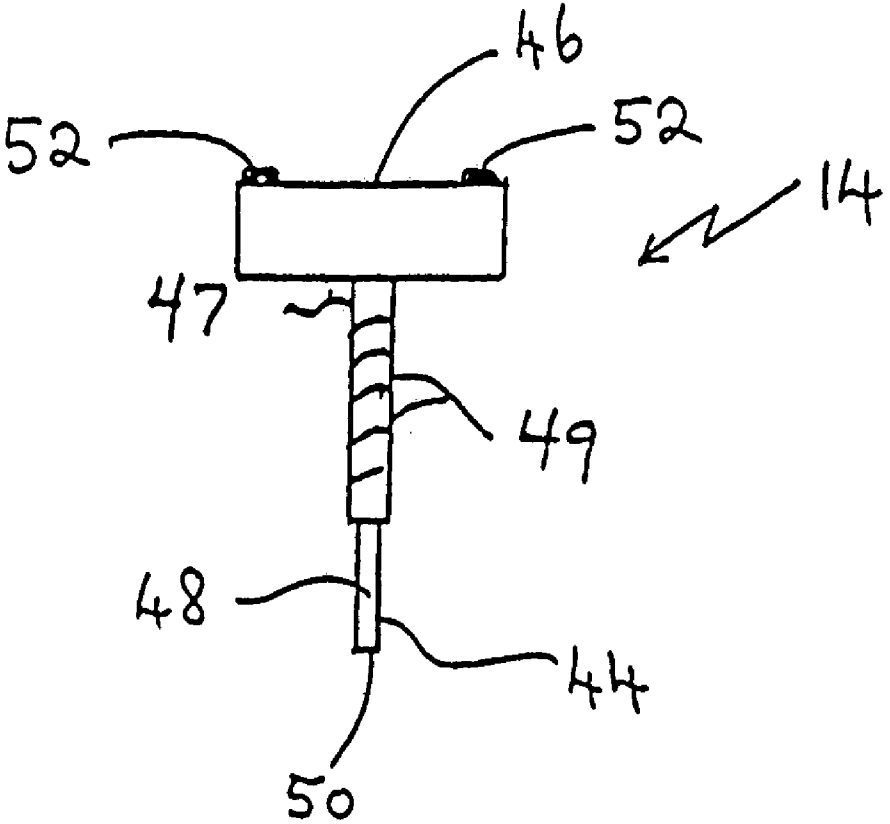
FIG. 3 is a side elevation view of a scoring member for use with the siding layout tool illustrated in FIG. 1.
Figure 5:
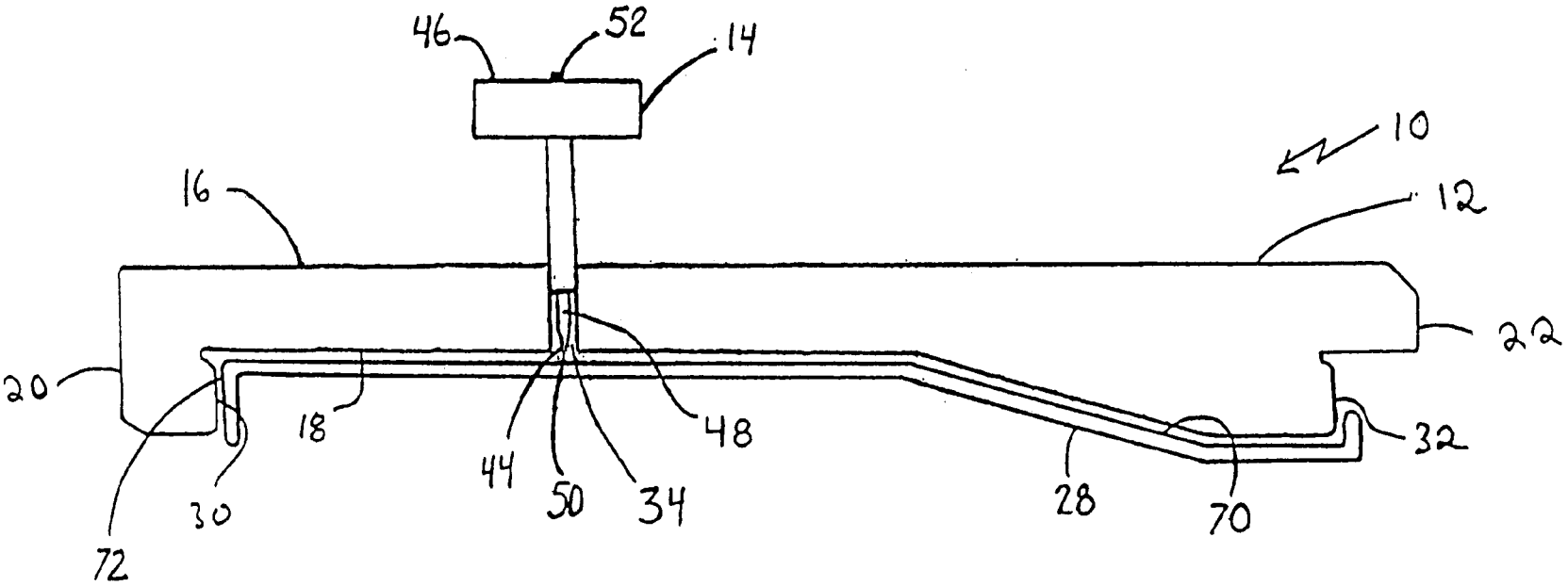
FIG. 5 is a side elevation view, in partial section, of the siding layout tool illustrated in FIG. 1, in use scoring siding.

Referring to FIG. 3, member 14 has a working end 44, a gripping end 46 and a shaft 47 that extends between working end 44 and gripping end 46. Positioned on shaft 47 are helical threads 49. Referring to FIG. 1, member 14 is received in threaded engagement in a selected one of the plurality of holes 34 in body 12. Gripping end 46 extends from first face 16 and working end 44 extends from second face 18. Referring to FIG. 3, when member 14 is a scoring tool, working end 44 is a blade 48 having a sharpened edge 50. A pair of alignment indicia 52 are aligned with sharpened edge 50 so as to show the orientation when blade 48 is positioned within hole 34 of body 12, as illustrated in FIG. 5. When member 14 is a marking tool, blade 48 is replaced with a marking implement. When member 14 is a cutting tool, blade 48 has an angled sharpened edge 50 and one of alignment indicia 52 differs from the other of alignment indicia 52 so as to indicate the direction of the angle of sharpened edge 50.

Referring to FIG. 1, a profile of first side 24 is a mirror image to a profile of second side 26, and is such that body 12 fits closely to the contours of siding 28 when body 12 is lain over siding 28, as illustrated in FIG. 5. Second face 18 of body 12 of first embodiment of siding layout tool 10 from first end 20 to second end 22 has a surface profile that is adapted to overlay and fit closely to the profile of siding 28. In this first embodiment the tool illustrated is adapted to fit the profile of cove style siding.

Figure 6:
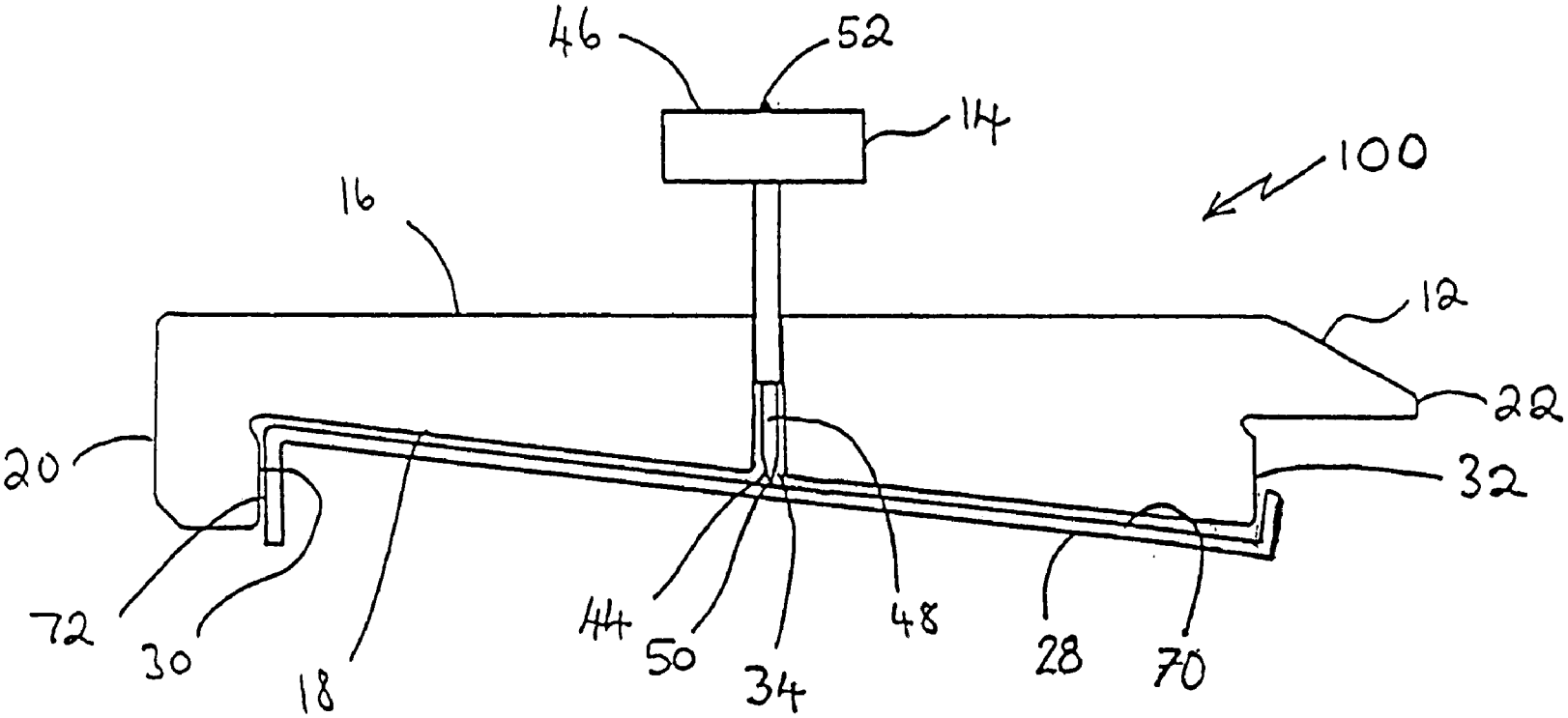
FIG. 6 is a side elevation view, in partial section, of a second embodiment of a siding layout tool constructed in accordance with the teachings of the present invention.
Figure 1:
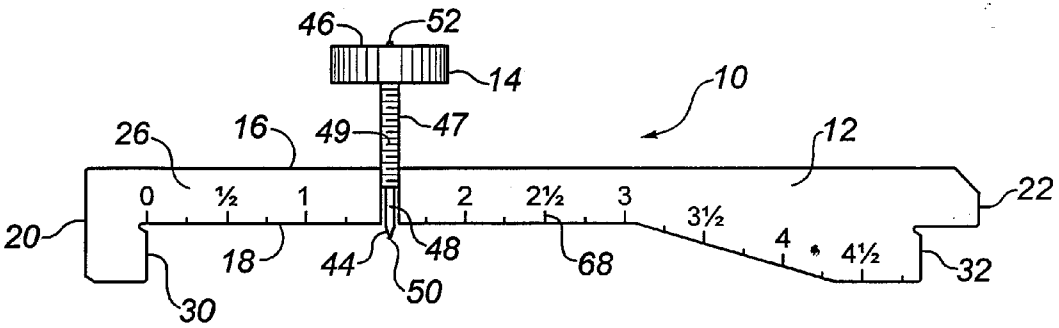
Figure 2:
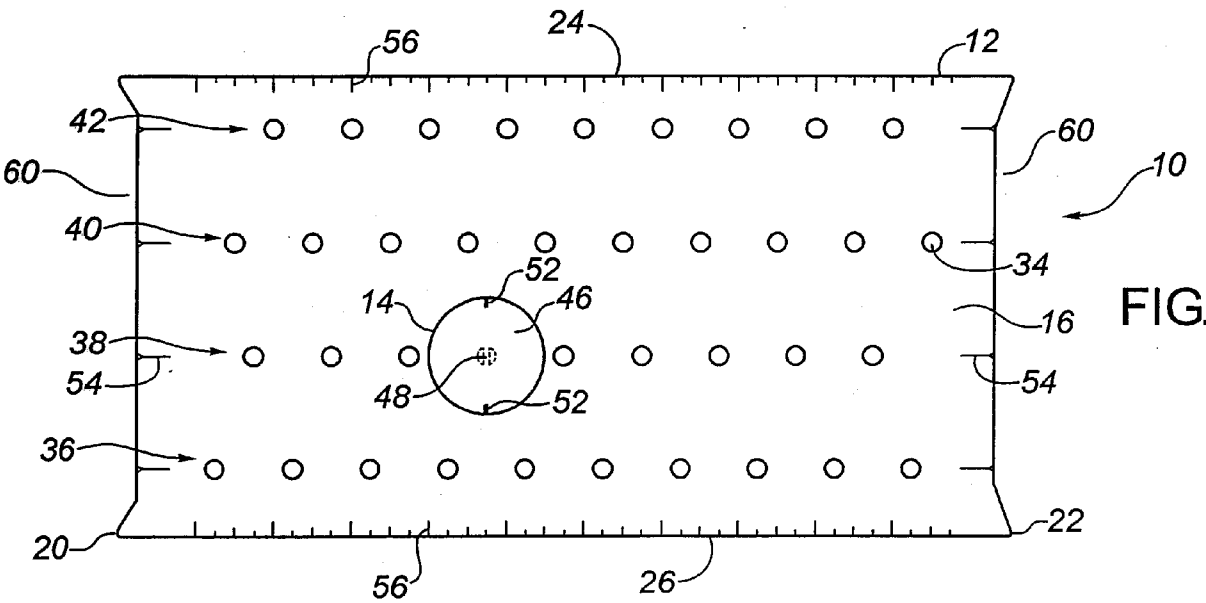
Figure 3:
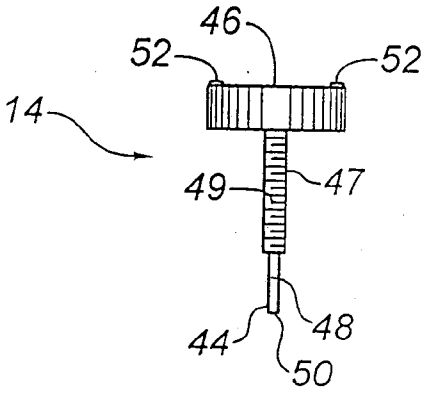
Figure 4:
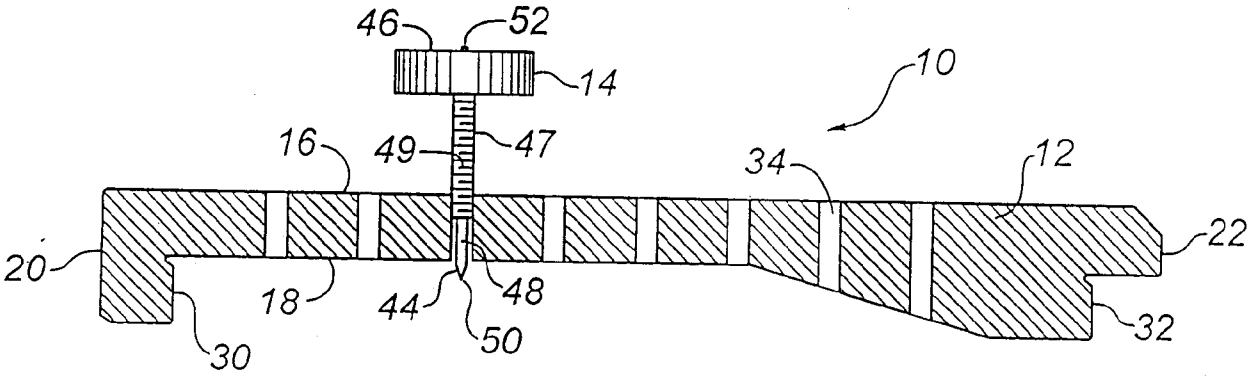
Figure 5:
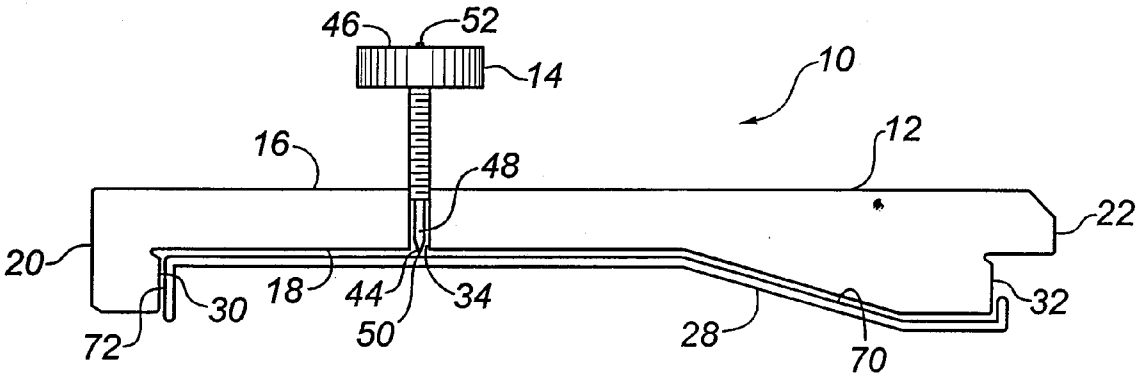
Figure 6:
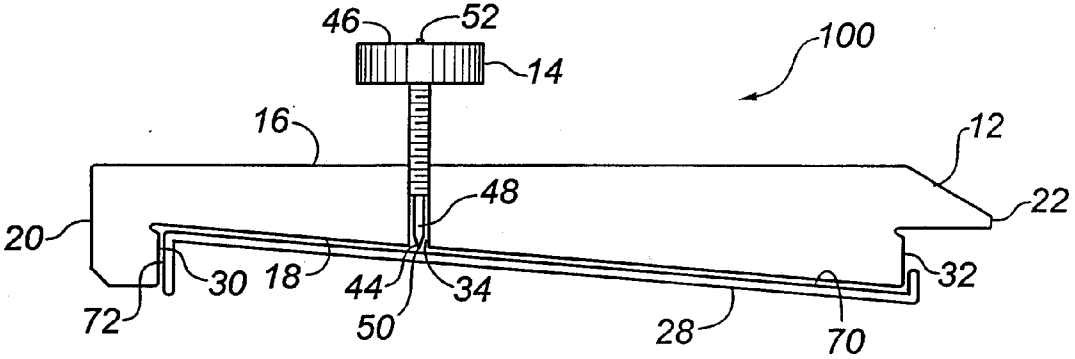

Referring to FIG. 6, alternative embodiment of siding layout tool 100 is substantially similar to preferred embodiment of siding layout tool 10, except that the surface profile on second face 18 has been altered to accommodate a different style of siding, bevelled siding.

It will be recognized that the profile of the body can be changed to create alternative embodiments of siding layout tool designed to match different contours of siding or other materials to be marked, scored or cut.

Each of the plurality of holes 34 preferably is marked with its own individual second numeric indicia 66 which, for clarity of illustration, are shown only for holes 34 of first row 36 and fourth row 42 in FIG. 2. Referring to FIG. 1, third numeric indicia 68 also may be marked on one or both of first side 24 and second side 26 adjacent second face 18, to provide further guidance in the use of preferred siding layout tool 10. Similarly, first numeric indicia 54, second numeric indicia 56, individual second numeric indicia 66 and third numeric indicia 68 are marked on alternative siding layout tool 100.

The use of preferred siding layout tool 10 will now be described. Member 14, selected from a scoring member as illustrated in FIG. 3, a marking member and a cutting member, is inserted into a selected hole 34 in body 12, as illustrated in FIG. 2, so that working end 44 extends past second face 18 and gripping end 46 extends from first face 16, as illustrated in FIG. 1. It is preferred that member 14 be threaded into place by manipulating gripping end 46 until working end 44 projects a desired distance past second face 18. Threads 49 engage holes 34 to hold member 14 in position and maintain the desired positioning of working end 44. Referring to FIG. 5, body 12 is lain over a surface 70 of section of siding 28 so that first alignment guide 30 abuts an edge 72 of siding 28. For purposes of illustration, when member 14 is the scoring member illustrated in FIG. 3, body 12 is moved laterally along section of siding 28 and working end 44 scores surface 70 of section of siding 28 in a line parallel to edge 72, illustrated in FIG. 5. Referring to FIG. 6, alternative embodiment of siding layout tool 100 is used in the same manner as preferred embodiment of siding layout tool 10, to score, mark or cut a section of siding with a profile different to that illustrated in FIG. 5.

Several advantages are conferred by the teachings of the present invention. The siding layout tool is easily used with only one hand, because member 14 is securely held in place in body 12. Member 14 is easily and rapidly set securely in place in a selected hole 34 in body 12. The tool can be used with equal facility by either right-handed or left-handed persons. The tool can be used easily by a person who is using his other hand to hold on to a ladder or scaffolding. Body 12 can be either pushed or pulled along siding 28. The tool is sufficiently small and light in weight that it can be easily carried in a pocket or pouch. The tool can be made of any one of a variety of materials or a composite, to convey the properties of rigidity, light weight construction, and durability. When working end 44 of member 14 becomes worn or is damaged, it is easily replaced. Working member 14 can be repositioned after a first use in order to perform a second use, such as making a second score or marking on the same section of siding 28. It is preferred that the profile of the tool fits closely to the profile of the section of siding with second face 18 in contact with section of siding 28, thereby providing a firm positioning of the tool during use. Either first alignment guide 30, second alignment guide 32 or both can be used to accurately position the tool as it is moved laterally along section of siding 28. Each of first end 20 and second end 22 have indentations 60 to enable a user to readily see start and stop marks for any score or cut. First numeric indicia 54 allow a user to easily line up cut outs for tops and bottoms of windows, doors, or other openings. Each of first side 16 and second side 18 are squared and have second numeric indicia, and can serve as a measure or a squaring tool. The holes are placed in rows and are separated by increments appropriate for the selected type of siding to be scored, cut or marked. When Imperial measurements are to be used for standard sizes of siding, as used in North America for example, the holes are at increments of one-eighth of one inch, to four and one-half inches for nine inch cove siding, to five inches for ten inch cove siding, to four inches for eight inch bevel siding, and to five inches for ten inch bevel siding. The tool as described allows a user to score marks into siding so that there is no need to use a cutter such as tin snips or a knife blade to make horizontal cuts in the siding material, thereby reducing a risk of an irregular or misaligned cut. Further, the time required for cutting a section of siding is reduced compared to the use of tin snips or a knife blade. A disadvantage of the Bouska et al tool, was that the siding had to be off the building in order for the tool to be used. This made the Bouska et al tool unsuitable for use when making repairs. The form of alignment guides with the illustrated embodiments, enables proper alignment when doing repairs.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A siding layout tool, comprising:

a body having a first face, a second face, a first end, a second end, a first side, and a second side, the first face being substantially planar and the second face not being parallel to the first face and having a surface profile adapted to overlay and fit closely siding;

at least one alignment guide positioned on the second face at one of the first end and the second end, the at least one alignment guide being adapted to guide movement of the body along the siding;

a plurality of holes extending through the body from the first face to the second face, each of the plurality of holes having internal threads;

a cutting member having a working end and a gripping end, the member being received in a selected one of the plurality of holes in the body, with the gripping end extending from the first face and the working end extending from the second face, the cutting member having external threads which mate with internal threads in the selected one of the plurality of holes; and numeric indicia on the planar first face defining the relationship each of the plurality of holes have to at least one of the first end, the second end, the first side, and the second side.

2. The siding layout tool as defined in claim 1, wherein a first alignment guide is positioned at the first end and a second alignment guide is positioned at the second end.

* * * * *

UNITED STATES PATENT AND TRADEMARK OFFICE

CERTIFICATE OF CORRECTION

PATENT NO. : 6,484,411 B1
DATED : November 26, 2002
INVENTOR(S) : Nixon

It is certified that error appears in the above-identified patent and that said Letters Patent is hereby corrected as shown below:

The Title page, should be deleted to be replaced with the attached title page.

Drawing sheets 1-3 should be deleted to be replaced with Drawing sheets 1-3, consisting of Figs. 1-6, as shown on the attached pages.

Signed and Sealed this

Twenty-ninth Day of July, 2003

JAMES E. ROGAN
*Director of the United States Patent and Trademark Office*

(12) United States Patent
Nixon

(10) Patent No.: US 6,484,411 B1
(45) Date of Patent: Nov. 26, 2002

(54) SIDING LAYOUT TOOL

(76) Inventor: Russell Nixon, 31 Glenwood Crescent, Stony Plain, Alberta (CA), T7Z 1A3

( * ) Notice: Subject to any disclaimer, the term of this patent is extended or adjusted under 35 U.S.C. 154(b) by 0 days.

(21) Appl. No.: 09/713,925

(22) Filed: Nov. 15, 2000

(30) Foreign Application Priority Data

Nov. 15, 1999 (CA) ..... 2289800

(51) Int. Cl.[7] ..... B43L 13/00
(52) U.S. Cl. ..... 33/33; 33/42; 33/411
(58) Field of Search ..... 33/32.1, 32.2, 33/32.5, 32.7, 33, 42, 526, 648, 646, 647, 481, 411, 649, 41.1, 41.4, 41.5, 41.6, 44, 666, 677

(56) References Cited

U.S. PATENT DOCUMENTS

| | | | | | |
|---|---|---|---|---|---|
| 72,885 | A | * | 12/1867 | Nester | 33/33 |
| 349,523 | A | * | 9/1886 | Schmidt | 33/33 |
| 810,246 | A | * | 1/1906 | Anderson | 33/42 |
| 913,871 | A | * | 3/1909 | Baightel | 33/33 |
| 1,255,190 | A | * | 2/1918 | McBride | 33/41.1 |
| 1,780,849 | A | * | 11/1930 | Spillman | 33/33 |
| 3,986,418 | A | | 10/1976 | Lang et al. | 83/41 |
| 4,407,179 | A | | 10/1983 | Iwase et al. | 83/865 |
| 4,510,834 | A | | 4/1985 | Greene et al. | 83/453 |
| 4,879,818 | A | | 11/1989 | Beaulieu | 33/646 |
| 4,955,305 | A | | 9/1990 | Garnier et al. | 112/121.11 |
| 4,956,919 | A | * | 9/1990 | Granger | 33/32.2 |
| 4,970,600 | A | | 11/1990 | Garnier et al. | 358/299 |
| 5,010,795 | A | | 4/1991 | Kania | 83/607 |
| 5,038,477 | A | | 8/1991 | Parrow | 30/253 |
| 5,038,483 | A | * | 8/1991 | Witek | 33/42 |
| 5,195,412 | A | | 3/1993 | Flemming et al. | 83/37 |
| 5,203,090 | A | | 4/1993 | Bouska et al. | 33/481 |
| 5,251,524 | A | | 10/1993 | Clifford | 83/383 |
| 5,375,339 | A | | 12/1994 | Noel, Jr. | 33/518 |
| 5,456,015 | A | * | 10/1995 | Butcher et al. | 33/451 |
| 5,625,992 | A | | 5/1997 | Strick et al. | 52/656.9 |
| 5,822,871 | A | * | 10/1998 | Walker | 33/27.03 |

* cited by examiner

*Primary Examiner*—Diego Gutierrez
*Assistant Examiner*—Mirellys Jagan
(74) *Attorney, Agent, or Firm*—Christensen O'Connor Johnson Kindness PLLC

(57) ABSTRACT

A siding layout tool includes a body having a first face, a second face and at least one alignment guide. A plurality of holes extend through the body from the first face to the second face. A member is provided having a working end. The member is received in a selected one of the plurality of holes in the body, with the working end extending from the second face. The siding layout tool, as described, permits one handed operation, which leaves the users other hand free.

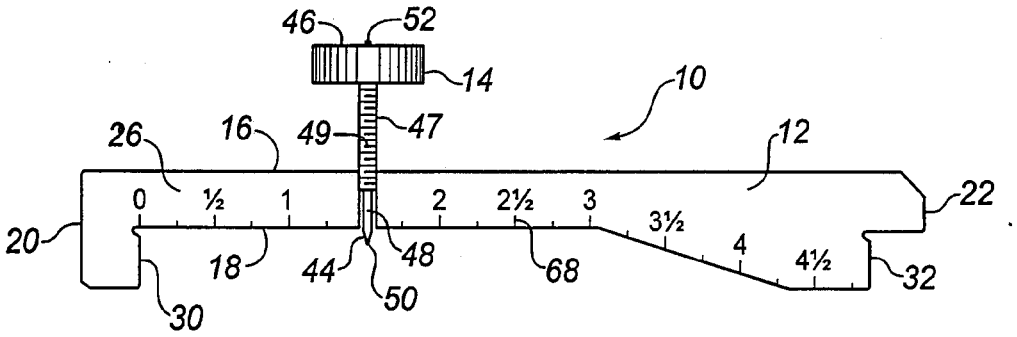

2 Claims, 6 Drawing Sheets